United States Patent [19]

Mobrem

[11] Patent Number: 4,941,668

[45] Date of Patent: Jul. 17, 1990

[54] WORD PUZZLE CARD GAME

[76] Inventor: Matthew M. Mobrem, 3203 Nuttree Woods Dr., Midlothian, Va. 23112

[21] Appl. No.: 389,858

[22] Filed: Aug. 4, 1989

[51] Int. Cl.[5] ..... A63F 3/00

[52] U.S. Cl. ..... 273/248; 273/240; 273/272; 273/DIG. 2; 273/DIG. 16; 273/153 R; 283/49

[58] Field of Search ..... 273/272, 249, 248, 153 R, 273/155; 283/49, 17

[56] References Cited

U.S. PATENT DOCUMENTS

| | | | |
|---|---|---|---|
| 1,642,424 | 9/1927 | Massey | 273/153 R |
| 1,988,273 | 1/1935 | Frost | 273/153 R |
| 2,159,563 | 5/1937 | McNaney | 273/272 |
| 3,263,999 | 8/1966 | McCoy | 273/293 |
| 3,411,221 | 11/1968 | Clark | 273/293 |
| 4,165,878 | 8/1979 | Frain | 273/240 |
| 4,340,231 | 7/1982 | Cammarata | 273/243 |
| 4,780,162 | 12/1988 | Harris | 273/272 |

*Primary Examiner*—Benjamin Layno

[57] ABSTRACT

A word puzzle card game employs template mask devices and puzzle cards. Individual puzzle cards, having puzzle-words or phrases imprinted thereon, are movably inserted into individual template mask devices, and are displaced therein to successively reveal, through a plurality of mask windows, individual location indicia and associated characters of puzzle-words or phrases to permit solving of the puzzle. Particular scoring values are indicated by the displacement position of puzzle cards. Tracking of characters in their locations according to associated location indicia is facilitated by puzzle tracking sheets. Tracking and display of players' successes in puzzle solving can be provided by movement of game pieces upon fields of a game board in accordance with game rules which can further introduce elements of luck and skill into the game.

9 Claims, 4 Drawing Sheets

WORD PUZZLE CARD GAME

BACKGROUND OF THE INVENTION

1. Field of the Invention

This invention relates to Word puzzle games employing cards movably inserted into templates to selectively reveal, through a plurality of windows, characters of puzzle-words or phrases, and which can additionally employ game boards to track and display players' successes.

2. Prior Art and Other considerations:

Puzzle and board games, as well as combinations thereof, have been a source of entertainment for literally hundreds and probably even thousands of years. Word puzzle games have become particularly popular in recent decades. Puzzle-like competitive games that combine progress of game pieces and/or characters and words and joining thereof upon board-like surfaces, such as for instance, various word dominoes, crossword puzzle varieties, and word guessing games have become rather popular.

Word games involving masks or perforated window-like structures to obstruct or reveal characters, symbols, or patterns to provide clues toward puzzle solutions have also been proposed. For instance, U.S. Pat. No. 3,411,221, issued to Clark, discloses a word game having cards with a predetermined number of holes for representing an unknown word. One of these cards is selected and placed against a card having a blackened area representing a known word. By a systematic comparison procedure with various known word cards, the unknown word may be determined.

U.S. Pat. No. 3,263,999, issued to McCoy, discloses a concept of providing a plurality of game cards, each card containing a relatively large number of light-transmitting windows different from each other card. A master card is superimposed over the playing card to obscure the windows until enough windows are obscured to illustrate a word.

U.S. Pat. No. 2,159,563, issued to McNaney, discloses a card game having perforated playing cards designed for superimposition upon indicia-bearing base cards to produce an intelligible aggregate of elements. The base cards may bear letters.

U.S. Pat. No. 4,789,878, issued to Harris, shows a word and message forming game board for filling in of missing letters. Clues are used to complete the messages.

The word puzzle card and board game according to the present invention employs a plurality of different puzzle cards having different words or phrases imprinted thereon with each character disposed in certain specific locations associated with location indicia, the puzzle cards being inserted displaceably behind a template mask device, so that only certain locations are readable and, upon relative displacement, certain other locations become revealed. The game can further employ a game board having series of adjoining fields upon which game pieces are moved by players in accordance with the degree of success of players in guessing game card words or phrases as characters thereof are selectively revealed by the template mask device during step-by-step displacement of the cards in the template mask devices by players taking their turn.

Accordingly, an object of the invention is the provision of at least one template mask device and a plurality of puzzle cards, any one card thereof displaceably fitting behind the template mask device, so that characters in association with corresponding location indicia imprinted upon the particular puzzle card are selectively revealed by the template mask device to provide to players bases for puzzle solution guesses. There can further be provided a game board having a series of fields for movement of game pieces thereupon in accordance with the degree of success of a player in guessing words or phrases disposed on puzzle cards.

SUMMARY

The word puzzle card game according to principles of the present invention employs a plurality of different puzzle cards having different words or phrases imprinted thereon with each character disposed in certain specific locations associated with location indicia, the puzzle cards being inserted displaceably behind a template mask device, so that only certain locations are readable and, upon relative displacement, certain other locations become revealed. Players in turn disclose revealed location indicia and associated characters to the other players until a player has correctly guessed the puzzle-word or phrase upon a card. A game board can be further provided for tracking and display of players' successes by movement of game pieces along fields on the board. Upon a correct guess, a successful player is permitted to move a game piece upon the board by a number of fields corresponding to a bonus or score value indicated upon the template at the time of the guess. A plurality of serially adjoining fields is arranged in a path beginning with a start position field and terminating in an end or home position field. Each player has at least one game piece which is advanced along the adjoining fields in accordance with the degree of success achieved in guessing puzzles.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference numerals refer to like parts throughout different views. The drawings are schematic and not necessarily to scale, emphasis instead being placed upon illustrating principles of the invention.

DESCRIPTION OF THE PREFERRED EMBODIMENTS

Figure 1:
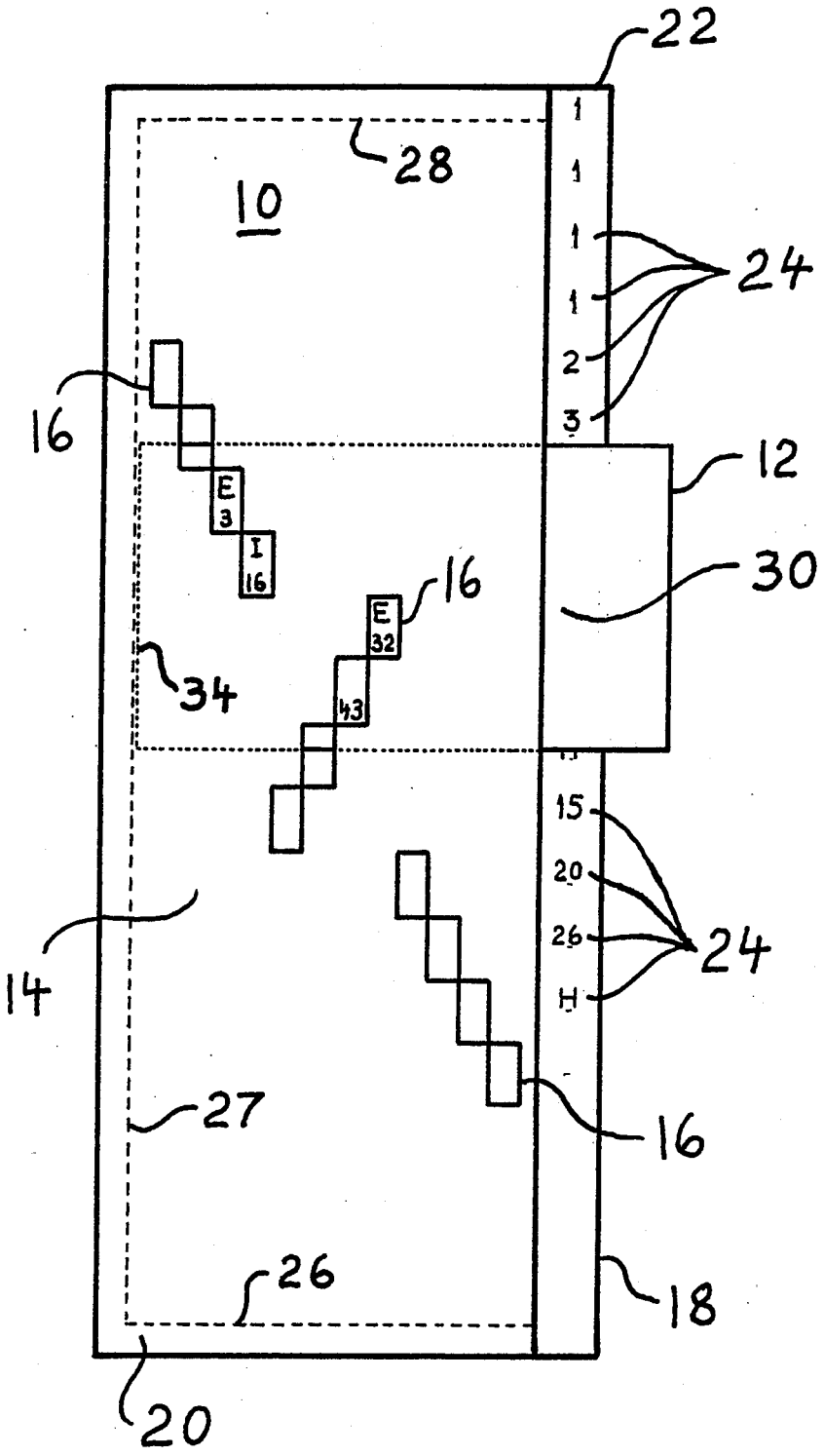
FIG. 1 is a schematic top view of a template mask device having a puzzle card disposed therein in accordance with principles of the invention.

Referring now to FIG. 1, there is depicted a means for selective revealing and disclosing of characters of puzzle-words or phrases comprising a template mask device 10 having a puzzle card 12 inserted therein. Puzzle card 12 is shown in more detail in FIG. 2. Template mask device 10 comprises a masking means 14 in form of a flat sheet of opaque or opaqued material that is provided with a plurality of transparent or cut out windows 16. Windows 16 are disposed within a two-dimensional matrix having a plurality of rows and columns. The locations of individual windows can be varied in different template mask devices, provided that at least one window is generally disposed in each row and in each column.

In a preferred embodiment, template mask device 10 further comprises a back plate 18 and a framework 20. Backplate 18 is disposed in substantially parallel relationship with respect to masking means 14 and is spaced therefrom by the thickness of framework 20. This thickness is slightly larger than the thickness of puzzle card 12. Backplate 18 is shown to have an extension 22 reaching by a small distance beyond the right edge of masking means 14. Extension 22 is provided with score markings 24. Framework 20 includes inside edges 26, 27, and 28 (hidden behind masking means 14) shown here in dashed lines.

Template mask device 10 thusly provides a receptacle region between masking means 14, back plate 18, and inside edges 26, 27, and 28 for receiving a puzzle card, for example puzzle card 12, in the orientation shown. Template mask device 10 can be made from plastic material, for instance acrylic, styrene, ABS, or similar plastic, or it can be of heavy paper, cardboard, and the like. Puzzle card 12 is provided with at least one imprinted surface 30. When puzzle card 12 is properly inserted into template mask device 10, imprinted surface 30 faces toward masking means 14 and imprinted characters are right-side-up, as shown.

A puzzle card is inserted into the receptacle region until it registers against inside edge 27 and it is displaceable, while substantially sliding along inside edge 27, throughout the receptacle region between inside edges 26 and 28. As puzzle card 12 is thusly displaced, characters and indicia imprinted thereupon are selectively revealed (and again concealed) in windows 16.

Figure 2:
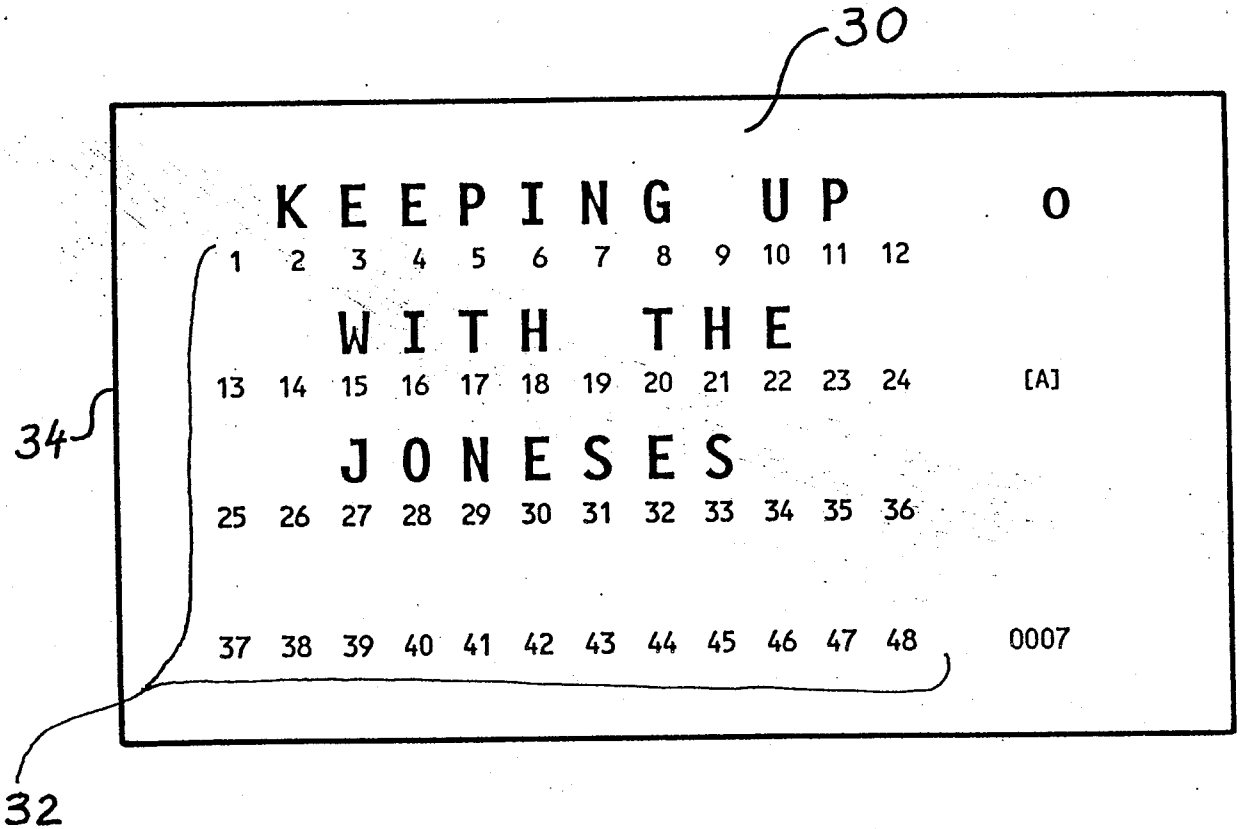
FIG. 2 is a schematic view of a typical puzzle card, as for instance indicated in FIG. 1.

Referring now more particularly to FIG. 2, imprinted surface 30 on puzzle card 12 is shown to bear a matrix of indicia 32 in form of numbers between one and forty eight, each indicium identifying a cell of the matrix. Each indicium is disposed in a specific location with respect to the edges of puzzle card 12, which locations and corresponding indicia are identical in all puzzle cards employed for the game of the present invention. The left edge of puzzle cards (for instance puzzle card 12 in FIGS. 1 and 2) serves as a registration edge 34 for alignment of a puzzle card with inside edge 27 of template mask device 10. Imprinted surface 30 on puzzle card 12 further comprises a puzzle-word or phrase whose characters (and spaces) are disposed each within a cell of the matrix in association with a specific indicium of that particular cell. It should be understood that a plurality of different puzzle cards is provided for a game of the invention, wherein different puzzle cards are provided with different puzzle-words or phrases. The here shown puzzle card 12 represents a typical example with respect to the depicted phrase.

As also shown in FIG. 2, imprinted surface 30 of puzzle card 12 can bear additional markings as represented by the shown '0' marking near the upper right corner, by the shown [A] marking in the middle of the right side, and by the '0007' marking near the lower right corner. For example, the '0' marking can serve to guide a player to the position near which a particular score value of score markings 24 (upon template mask device 10 in FIG. 1) is to be read. This '0' marking can be advantageously replaced by other markings, as for instance by an upwardly pointing arrow, to more appropriately guide a player's eyes to such particular score value. Further, for example, the [A] marking can correspond to the category of the particular puzzle card and the '0007' marking can be an identifying code for inventory control (used in manufacturing).

Referring back to FIG. 1, in view of the description provided hereinabove in conjunction with FIG. 2, locations of windows 16 correspond to locations of cells of the matrix when a puzzle card is disposed within the receptacle region in registration along inside edge 27, so that each cell is selectively revealed (and again concealed) as a puzzle card is displaced throughout the receptacle region while sliding substantially along inside edge 27. For instance, as shown in FIG. 1 for a particular displacement position of puzzle card 12 with respect to template mask device 10, certain windows (among windows 16) reveal the characters (of the puzzle phrase on puzzle card 12) 'E', 'I', and 'E' together with their respective cell indicia '3', '16', and '32'. It will be clear that the shape and size of windows 16 corresponds substantially to the size and shape of cells of the matrix, so that a cell indicium and the associated character (when revealed) can be read through a window. Thus every character (of the puzzle phrase on puzzle card 12) will be ultimately revealed if the particular puzzle card in use is moved, for instance, from its lowermost location in the template mask device 10 to its uppermost location therein successively one row (one window) at a time. While a puzzle card is in particular locations in template mask device 12, one or more characters (together with associated indicia) can be simultaneously seen through one or more windows 16 (one character per window). For instance, three characters can be seen in the particular example shown in FIG. 1.

In use, a puzzle card is inserted into template mask device 10 until registration edge 34 contacts inside edge 27. Initially, the card is positioned at the lowermost location within template mask device 10, so that the bottom edge of the puzzle card contacts inside edge 26. A first cell of the matrix of cells on the puzzle card is revealed by the lowermost window (of windows 16), and the content of this cell can be read. Subsequently, the puzzle card is displaced upwardly so that the next higher window in template mask device 10 reveals another cell on the puzzle card, and successive upward displacements of the puzzle card in displacement steps corresponding to the vertical spacing between windows reveal further cells through respective higher windows. In view of the preceding description, it will be understood that vertical spacings between window rows are at least equal to or larger than corresponding vertical spacings between cells upon puzzle cards, and that horizontal spacings between window columns correspond to horizontal spacings between cells upon puzzle cards.

Each particular displacement position of a puzzle card is associated with a particular score value among score markings 24. A particular applicable score value is identified as being the value visible immediately above the top edge of a puzzle card. For instance, as depicted in FIG. 1, the score value associated with this particular displacement position is '3'. It will be recognized that score markings 24 follow a generally descending sequence of values (in an upward direction) in approximate correspondence with the decreasing degree of difficulty involved in guessing a puzzle-word or phrase as more characters thereof become known, having been revealed by the upward displacement of the puzzle card. Score markings 24 may be alternatively arranged so that a window provided in each puzzle card reveals particular score values. The particular vertical location of such a window on a puzzle card can be varied in accordance with the degree of difficulty assessed for the puzzle-word or phrase on the particular card to improve the equitability of scoring. Alternately, score markings 24 may be disposed in other locations upon template mask device 10; for instance on the surface of masking means 14 near and along the right side thereof. In the latter respect, a mark such as an arrow can be disposed in an appropriate position on the puzzle card to point to the applicable score marking. The lowermost score marking in FIG. 1 is shown as the character 'H'. This denotes a special bonus, as it corresponds to the unlikely situation when a puzzle solution has been found on the basis of the revelation of a single character only.

In play of the game of the present invention, the overall use of template mask device 10 in conjunction with a puzzle card (as for instance puzzle card 12) is as follows. Each player is provided with a template mask device and a puzzle card (from a large plurality of different cards). The player, whose turn it is, inserts the card into the template mask device and advances the card upwardly until a first character is revealed. The player discloses the revealed character's matrix indicium and the character itself to the other players, who attempt to guess the puzzle-word or phrase imprinted upon the card. Players write down such information in appropriate manner to assist in learning the character and its location given by the indicium. In turn, other players proceed in the same manner and, during successive turns, each player's puzzle cards are displaced further upwardly to reveal additional characters. When a player has guessed a puzzle correctly, the successful player is credited with the associated score value, and the now solved puzzle card is replaced by another card. Incorrect guesses may penalize or debit a player's score.

Figure 3:
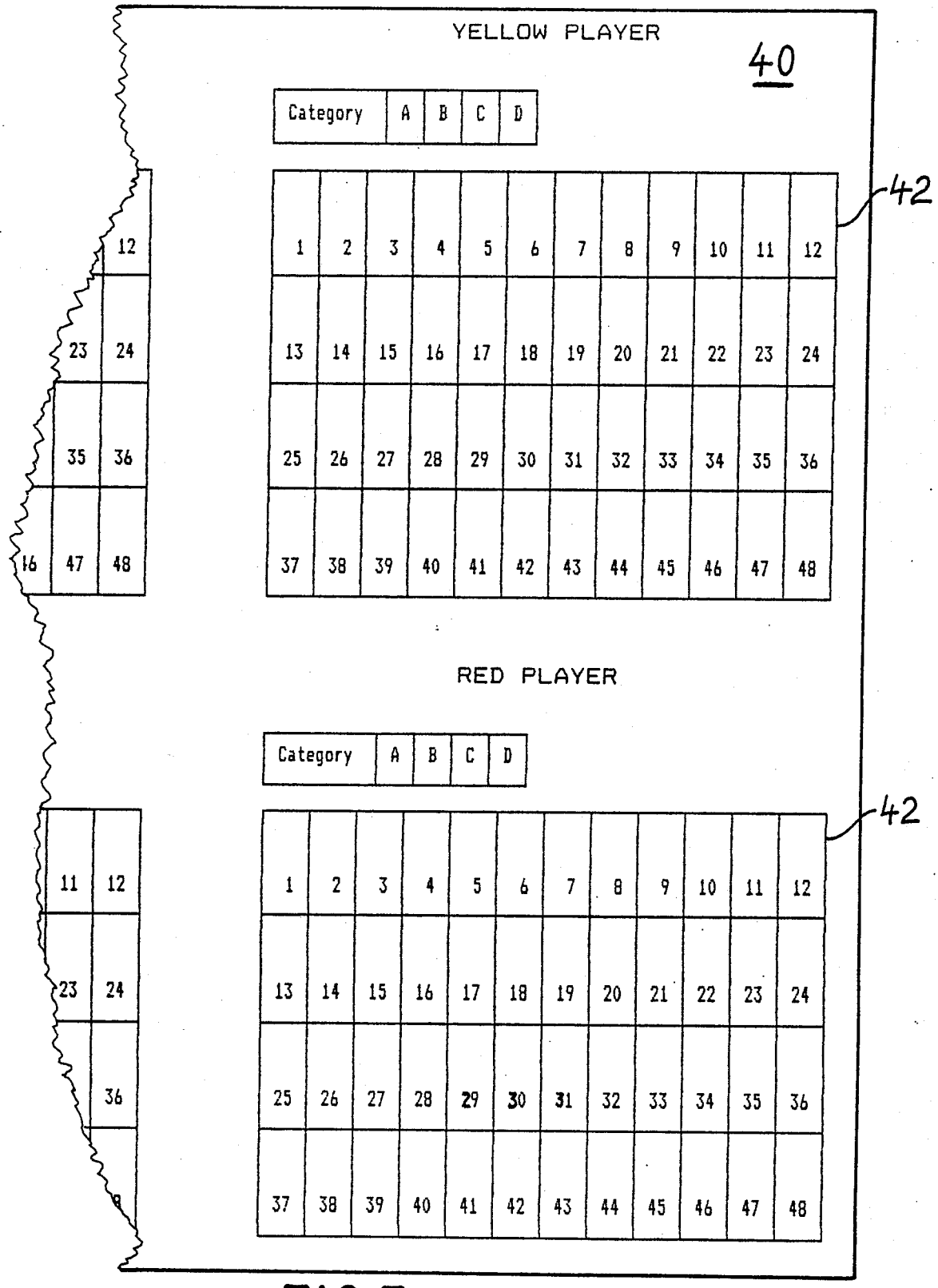
FIG. 3 is a schematic depiction of a fragment of an example of a puzzle tracking sheet of the invention.

Referring now to FIG. 3, a puzzle tracking sheet 40 is shown that serves to assist a player in recording and tracking revealed characters and corresponding indicia in a systematic manner. Puzzle tracking sheet 40 facilitates recognition and guessing of puzzle-words or phrases by providing for each puzzle card used in the game a matrix of fields 42 having indicia identical to those in the matrix of indicia 32. During a game, revealed and disclosed characters are entered into the matrix of fields 42 in the correct locations corresponding to particular characters' matrix indicia. Puzzle tracking sheet 40 further comprises identifying information to associate a particular matrix of fields with a player and other useful information, such as for instance the particular applicable puzzle card category.

Figure 4:
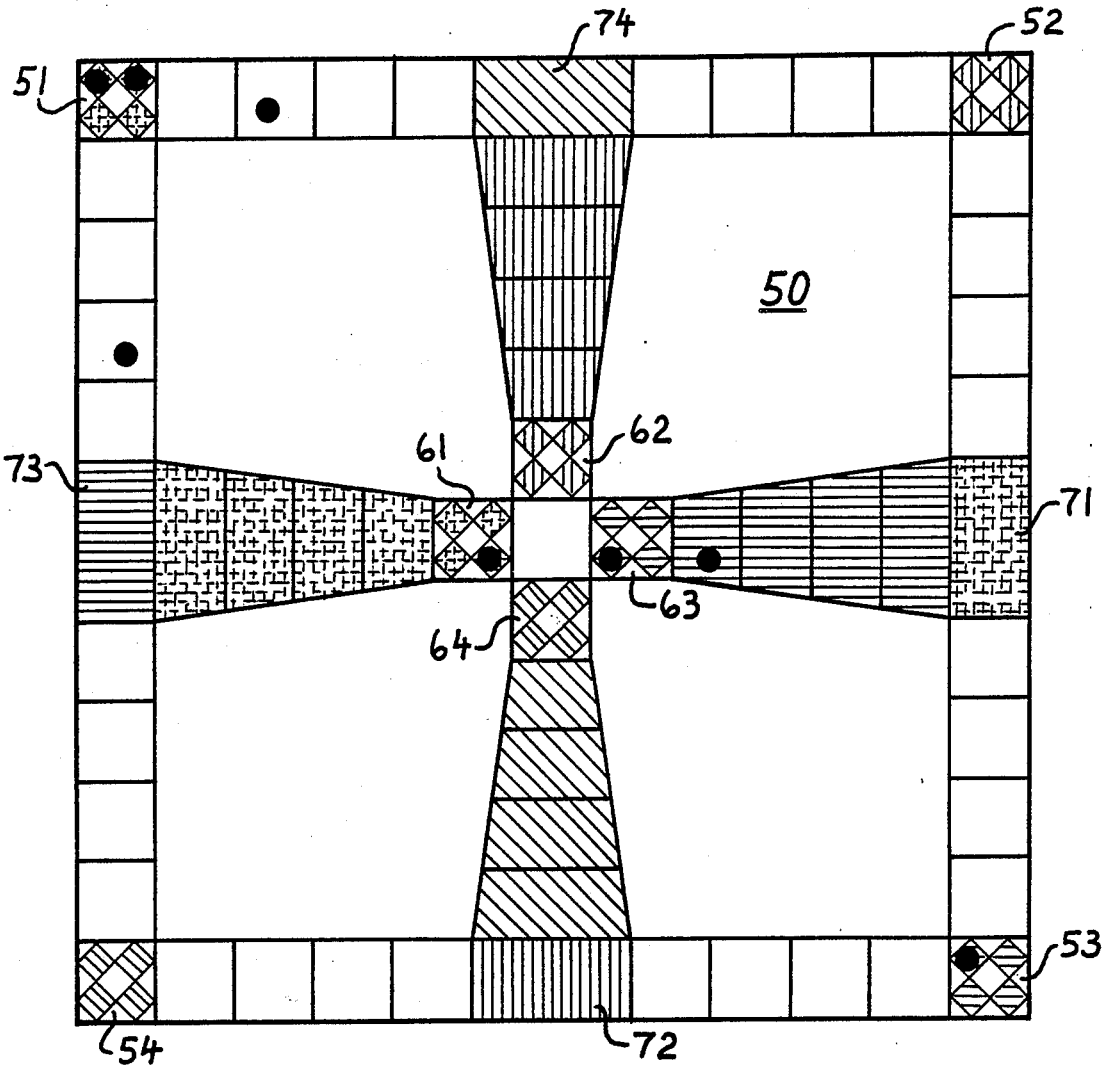
FIG. 4 is a schematic top view of the surface of the game board of the invention showing game pieces disposed thereupon.

Referring to FIG. 4, a game board 50, for use in the game of the invention, is shown for positioning of game pieces thereupon to track and display game players' success in puzzle solving and to provide additional game features and modifiers. Game board 50 comprises a surface imprinted with a plurality of fields in various sizes, shapes and colors. Game pieces movably disposed upon game board 50 in various fields are indicated by black-filled circles. In particular, start or base fields 51, 52, 53, 54 (yellow, red, blue, green, respectively) are disposed at the corners of the board, and home fields 61, 62, 63, 64 (yellow, red, blue, green, respectively) are disposed near the center of the board. Additional fields are adjoinedly disposed along the peripheral edges of the board including mid fields 71, 72, 73, 74 (yellow, red, blue, green, respectively), each of which is connected via an array of connecting fields to the nearest home field. Each array of connecting fields is colored in the color of the home field to which it is connected.

Game pieces are provided in the same colors as the colors of fields upon game board 50. As a rule, four identically colored game pieces are provided for each player, and these are positioned, at the start of a game, upon the indicated squares within base fields of the matching color. Game pieces are advanced upon fields of game board 50 in a clockwise direction in accordance with scores achieved by players during puzzle solving, as hereinbefore described in conjunction with FIGS. 1 to 3. Further, upon reaching the region of connecting fields having the color of the player's game pieces, the game pieces are advanced thereupon toward the center of game board 50 and toward the adjoining home field. The winner of the game is the first player whose four game pieces reach the home field.

Mid fields 71, 72, 73, 74, when reached by a game piece of matching color, permit the game piece to be advanced directly to the field immediately preceding the home field of the matching color, namely the end zone field. This rule can be imprinted in each mid field. A game piece that advances onto the first field of a connecting field is penalized by having to return to its base field. This rule can be imprinted in each of the first fields of the connecting fields. Base fields are jumped over (not counted) during advances of game pieces. Various other rules may be included to increase or decrease the degree of difficulty or challenge and to introduce elements of luck.

In general, the player who reveals a puzzle character is permitted to roll a die and advance one game piece in accordance with the number rolled. Players have a fixed time to solve the puzzle after each revelation. In case of a tie between players simultaneously indicating knowing a solution, a majority vote and/or a roll of a die decides who may present a guess. A correct guess allows the player's game piece to be advanced by a number of fields corresponding to the score value achieved. An incorrect guess forces a game piece retreat by a certain number of fields or back onto the base field. A game piece may advance, during a turn of the respective player, onto its end zone field (and no farther) only on an exact count or score value. Game pieces may be advanced onto the home field only from the end zone field upon achievement of a correct puzzle solution, regardless of score value. The four squares within each home field are marked to represent the four puzzle categories played, and the first three game pieces reaching the home field may be placed upon any square. However, the remaining free square indicates the puzzle category in which a puzzle has to be solved in order to permit the remaining (fourth) game piece to advance onto the home field from the end zone field.

Game pieces may be advanced from a start field only when no game pieces of the same color are disposed on fields preceding the end zone (of the same color), or if the number rolled by the die or the score value of a solved puzzle is higher than needed to exactly enter the proper end zone field.

All players must have the puzzles on their puzzle cards solved, before new puzzle cards can be obtained (simultaneously by all players). A player, whose puzzle has been solved, continues to advance game pieces in accordance with a roll of the die (during the player's turn) and in accordance with the achieved score value associated with a puzzle guess. The winner of the game is the player who has first advanced all four game pieces onto the home field.

In order to further assist players during the game, each player can be issued a category card that lists available puzzle-word or phrase categories among the plurality of puzzle cards. Each player's category card is marked with the puzzle category of the puzzle card used at the time and with subsequently used categories for tracking thereof. The category card can be used by the player also as a flag or indicator to show readiness to attempt a guess at a solution of a puzzle.

It will be appreciated that the game of the invention exhibits considerable complexity and, therefore, provides for sustained high interest in players, combining challenge to skills with luck in order to somewhat equalize differences in skill levels among players. The template mask devices and the associated puzzle cards in conjunction with the puzzle tracking sheets particularly provide for simplification of and speed in the mechanics of the game playing procedure, so that the attraction of the complexity of the game does not become burdened by uninteresting and time consuming playing procedure mechanics that detract from enjoyment of the game.

While the invention has been particularly shown and described with reference to preferred embodiments thereof, it will be understood by those skilled in the art that various changes and modifications in form and details may be made therein without departing from the spirit and scope of the invention.

The embodiments of the invention in which an exclusive property or privilege is claimed are defined as follows:

1. A word puzzle card game comprising:

means for selectively revealing and disclosing characters of words, said means for selective revealing and disclosing including:

a plurality of puzzle cards each having imprinted upon a surface thereof a word or phrase to be determined; and, at least one template mask device having masking means for concealing portions of said surface while one of said plurality of puzzle cards is displaceably disposed behind said masking means in any one of a plurality of displacement positions, said making means having windows for selectively revealing said characters while said surface is partially concealed by said masking means, each of said plurality of puzzle cards being displaceable to said plurality of displacement positions with respect to said masking means to selectively reveal different said characters of said word or phrase; and, wherein said characters are located within cells of an identical matrix on each of said plurality of puzzle cards, said cells being arranged in rows and columns, each of said cells bearing a unique indicium, said indicium corresponding to the position of said each of said cells within said matrix, and wherein said windows selectively reveal said cells including said character or characters and said unique indicium located therein.

2. The word puzzle game of claim 1, wherein said windows are disposed in said masking means in relation to said cells, while one of said plurality of puzzle cards is disposed behind said masking means, in locations corresponding to locations of said columns, said windows being spaced along said columns, at least one of said windows being disposed in each location corresponding to each said column, so that each said cell is selectively revealed at least once during succesive displacements of said puzzle card in direction of succession of said rows with respect to said masking means.

3. The word puzzle game of claim 1, wherein said means for selectively revealing and disclosing includes a puzzle tracking sheet comprising a matrix of fields having fields corresponding to said cells of said identical matrix, said fields being marked with said unique indicia associated therewith, said puzzle tracking sheet serving for entering of revealed said characters into said fields in field locations corresponding to particular of said unique indicia revealed and disclosed in association therewith, so that successively revealed characters are entered in said puzzle tracking sheet to match the same character locations on the corresponding one of said plurality of puzzle cards to facilitate determination of a puzzle solution.

4. A word puzzle card game comprising:

means for selectively revealing and disclosing characters of words, said means for selective revealing and disclosing including:

a plurality of puzzle cards each having imprinted upon a surface thereof a word or phrase to be determined; and, at least one template mask device having masking means for concealing portions of said surface while one of said plurality of puzzle cards is displaceably disposed behind said masking means in any one of a plurality of displacement positions, said masking means having windows for selectively revealing said characters while said surface is partially concealed by said masking means, each of said plurality of puzzle cards being displaceable to said plurality of displacement positions with respect to said masking means to selectively reveal different said characters of said word or phrase; and, wherein said template mask device includes score markings, said score markings comprising individual score values, said individual score values being disposed in positions that are indicated by a respective displacement position of said one of said plurality of puzzle cards while said one of said plurality of puzzle cards is disposed behind said masking means, said score values being representative of a degree of difficulty associated with a correct determination of said words due to the revelation of said character in said respective displacement position.

5. A word puzzle card game comprising:

means for selectively revealing and disclosing characters of words, said means for selective revealing and disclosing including:

a plurality of puzzle cards each having imprinted upon a surface thereof a word or phrase to be determined; and, at least one template mask device having masking means for concealing portions of said surface while one of said plurality of puzzle cards is displaceably disposed behind said masking means in any one of a plurality of displacement positions, said masking means having windows for selectively revealing said characters while said surface is partially concealed by said masking means, each of said plurality of puzzle cards being displaceable to said plurality of displacement positions with respect to said masking means to selectively reveal different said characters of said word or phrase; and, including a game board having a plurality of fields disposed thereon for positioning of game pieces thereupon to track and display a game player's success in determining said words.

6. The word puzzle card game according to claim 5, wherein said game board comprises start, home, and tracking fields to track and display players' game progress status by positions of game pieces thereupon, and wherein selected ones of said tracking fields include selective advancing and retreating instructions for said game pieces, said game pieces being advanced or retreated upon said fields in correspondence with said score values achieved by players.

7. A word puzzle card game comprising:

a plurality of template mask devices; and, a plurality of puzzle cards, each puzzle card of said plurality of puzzle cards including at least one surface provided with a matrix of a plurality of cells, each of said plurality of cells bearing a different indicium identifying said cell, said matrix further comprising a word imprinted therein so that each character in said word is disposed within one of said plurality of cells; each template mask device of said plurality of template mask devices including:

a receptacle to receive any one of said plurality of puzzle cards, said puzzle card being displaceable over a displacement range within said receptacle;

a mask provided with a plurality of windows for revealing one or more of said cells to allow reading of a content thereof when said puzzle card is disposed within said receptacle, said plurality of windows being spatially arranged so that said content of every one of said cells is revealed at least once as said puzzle card is displaced over said displacement range; and, a score scale having a plurality of score markings to provide score values corresponding to displacement positions of said puzzle card when said puzzle card is disposed in said receptacle.

8. The word puzzle game of claim 7 including a game board and a plurality of game pieces for positioning on said game board, said game board including:

a plurality of fields for tracking and displaying the game player's degree of success in solving said puzzle card game by positioning of said game pieces upon said fields in accordance with said score values.

9. In a word puzzle game, means for selectively revealing characters of puzzle-words, said means for selective revealing comprising:

a plurality of puzzle cards, each of said plurality of puzzle cards including at least one surface provided with a matrix of a plurality of cells, each of said plurality of cells bearing a different indicium identifying said cell, said matrix further comprising a word or phrase imprinted therein so that each character in said word or phrase is disposed within one of said plurality of cells;

at least one template mask device, said template mask device including a receptacle to receive any one of said plurality of puzzle cards, said puzzle card being displaceable over a displacement range within said receptacle, said template mask further including a mask provided with a plurality of windows for revealing one or more of said cells to allow reading of a content thereof when said puzzle card is disposed within said receptacle, said plurality of windows being spatially arranged so that said content of every one of said cells is revealed at least once as said puzzle card is displaced over said displacement range, said template mask device also including a score scale having a plurality of score markings to provide score values corresponding to displacement positions of said puzzle card when said puzzle card is disposed in said receptacle.

* * * * *